US010706775B2

(12) United States Patent
Shin

(10) Patent No.: US 10,706,775 B2
(45) Date of Patent: Jul. 7, 2020

(54) DISPLAY DEVICE AND DRIVING METHOD OF THE SAME

(71) Applicant: LG Display Co., Ltd., Seoul (KR)

(72) Inventor: HongSeop Shin, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 49 days.

(21) Appl. No.: 16/013,217

(22) Filed: Jun. 20, 2018

(65) Prior Publication Data

US 2019/0005879 A1 Jan. 3, 2019

(30) Foreign Application Priority Data

Jun. 30, 2017 (KR) ..... 10-2017-0083418

(51) Int. Cl.

| | |
|---|---|
| ***G09G 3/3233*** | (2016.01) |
| ***G09G 3/3258*** | (2016.01) |
| ***G09G 3/00*** | (2006.01) |
| ***G09G 3/20*** | (2006.01) |

(52) U.S. Cl.

CPC ..... *G09G 3/3233* (2013.01); *G09G 3/003* (2013.01); *G09G 3/20* (2013.01); *G09G 3/3258* (2013.01); *G09G 2300/026* (2013.01); *G09G 2310/0232* (2013.01); *G09G 2310/0243* (2013.01); *G09G 2310/0264* (2013.01); *G09G 2310/08* (2013.01); *G09G 2320/0233* (2013.01); *G09G 2320/0261* (2013.01); *G09G 2320/068* (2013.01); *G09G 2340/14* (2013.01); *G09G 2354/00* (2013.01); *G09G 2380/02* (2013.01)

(58) Field of Classification Search

CPC ..... G09G 3/3233; G09G 3/3258; G09G 2310/0243; G09G 2310/0264; G09G 2310/08; G09G 2320/0233; G09G 2380/02; H01L 2251/5338

See application file for complete search history.

(56) References Cited

U.S. PATENT DOCUMENTS

| | | | | |
|---|---|---|---|---|
| 9,685,106 | B2 * | 6/2017 | Cha | G09G 3/20 |
| 2006/0001796 | A1 | 1/2006 | Chang et al. | |
| 2011/0050657 | A1 * | 3/2011 | Yamada | H01L 27/3293 345/204 |

(Continued)

FOREIGN PATENT DOCUMENTS

| | | | |
|---|---|---|---|
| KR | 10-2006-0001334 | A | 1/2006 |
| WO | 2015/026017 | A1 | 2/2015 |

*Primary Examiner* — Tom V Sheng

(74) *Attorney, Agent, or Firm* — Seed Intellectual Property Law Group LLP

(57) ABSTRACT

The present disclosure relates to a display device and a driving method of a display device. In one embodiment, the display device includes: a display panel having a plane area and at least one curved area outside of the plane area; a timing controller; and a data driver. The timing controller includes: an image analyzer which analyzes a portion of the image signal corresponding to the at least one curved area and a luminance controller which controls the portion of the image signal corresponding to the at least one curved area to increase a luminance of the at least one curved area. The luminance of the at least one curved area may be increased based on the viewing angle to increase the luminance uniformity of the display panel, thereby minimizing the deterioration of the image quality due to the curved area.

19 Claims, 13 Drawing Sheets

(56) References Cited

U.S. PATENT DOCUMENTS

| | | | | |
|---|---|---|---|---|
| 2011/0267541 | A1* | 11/2011 | Hirokane | G09G 3/36 348/671 |
| 2013/0135366 | A1 | 5/2013 | Araki | |
| 2014/0312319 | A1* | 10/2014 | Kim | H01L 27/3258 257/40 |
| 2015/0301672 | A1* | 10/2015 | Kim | G09G 3/20 345/156 |
| 2016/0027364 | A1* | 1/2016 | Park | G09G 3/20 345/690 |
| 2016/0117994 | A1* | 4/2016 | Lee | G09G 3/3406 345/694 |
| 2016/0148554 | A1 | 5/2016 | Lim et al. | |
| 2016/0196778 | A1* | 7/2016 | Cha | G09G 3/20 345/694 |
| 2016/0205391 | A1* | 7/2016 | Kim | H04N 13/376 348/51 |
| 2016/0210901 | A1 | 7/2016 | Cha et al. | |
| 2017/0118850 | A1* | 4/2017 | Kwon | G02F 1/133308 |
| 2017/0206859 | A1* | 7/2017 | Jun | G09G 5/10 |
| 2018/0075797 | A1* | 3/2018 | Park | G09G 3/2092 |
| 2018/0114474 | A1* | 4/2018 | Powell | G09G 3/02 |
| 2018/0368270 | A1* | 12/2018 | Seo | H05K 5/0017 |

* cited by examiner

DISPLAY DEVICE AND DRIVING METHOD OF THE SAME

CROSS-REFERENCE TO RELATED APPLICATIONS

This application claims the priority of Korean Patent Application No. 10-2017-0083418 filed on Jun. 30, 2017, in the Korean Intellectual Property Office, the disclosure of which is incorporated herein by reference.

BACKGROUND

Technical Field

The present disclosure relates to a display device and a driving method of the same, and more particularly, to a display device and a driving method of the same which increase a luminance of a curve area according to a viewing angle to uniformly control the luminance.

Description of the Related Art

As the information society is developed, demands for display devices for displaying images are increased in various forms. Recently, various display devices such as a liquid crystal display device, a plasma display panel, and an organic light emitting display device are utilized.

The display devices include a display panel in which data lines and gate lines are disposed and pixels are disposed at the intersections of the data lines and the gate lines. Further, the display devices include a data driver which supplies a data voltage to the data lines, a gate driver which supplies a gate voltage to the gate lines, and a timing controller which controls the data driver and the gate driver.

Specifically, recently, a flexible organic light emitting display device (flexible OLED) which may implement an image using a flexible substrate even though a display panel is bent has been developed.

A display panel of the flexible organic light emitting display device is divided into a flat plane area and a curved area which is bent at the outside of the plane area and an entire image is output through the plane area and the curved area. Here, a viewing angle of the plane area is 0° with respect to a front, but the curved area has a predetermined viewing angle with respect to a front.

In the related art, a luminance of a display panel which outputs the entire image is set to be constant based on a luminance of the plane area, regardless of the plane area and the curved area.

In this case, as seen from the front which is a viewing position, a luminance of the plane area is appropriately set to normally output an image. However, the luminance of the at least one curved area is recognized to be lower than the luminance of the plane area with respect to the front, due to a viewing angle of the curved area.

Accordingly, the flexible organic light emitting display device of the related art does not recognize uniform luminance through the entire display panel, so that image quality may be deteriorated due to luminance unevenness of the display panel.

BRIEF SUMMARY

In various embodiments, the present disclosure provides a display device and a driving method of the same which control the luminance to be uniform by increasing the luminance of the at least one curved area in accordance with the viewing angle.

Additionally, the present disclosure provides in various embodiments a display device and a driving method of the same which reduce the power consumption by activating a luminance compensating function based on an image signal.

Objects of the present disclosure are not limited to the above-mentioned objects, and other objects, which are not mentioned above, can be clearly understood by those skilled in the art from the following descriptions.

According to one or more embodiments of the present disclosure, a display device includes: a display panel having a plane area and at least one curved area disposed outside of the plane area; a timing controller which is applied with an image signal to generate image data; and a data driver which is applied with the image data to output a data voltage to a plurality of pixels disposed in the plane area and in the at least one curved area. The timing controller includes an image analyzer which analyzes a portion of the image signal corresponding to the at least one curved area, and a luminance controller which controls the portion of the image signal corresponding to the at least one curved area to increase a luminance of the at least one curved area.

According to another embodiment of the present disclosure, a driving method of a display device having a plane area and at least one curved area outside of the plane area includes: analyzing a portion of an image signal corresponding to the at least one curved area; and increasing a luminance of the at least one curved area based on the analyzing the portion of the image signal corresponding to the at least one curved area.

Other detailed matters of the embodiments are included in the detailed description and the drawings.

According to one or more embodiments of the present disclosure, the luminance of the at least one curved area is increased based on the viewing angle to increase the luminance uniformity of the display panel, thereby minimizing the deterioration of the image quality due to the curved area.

Further, according to one or more embodiments of the present disclosure, only when it is determined that a viewer watches the display device, the luminance compensating function is activated based on an average of a square of predicted luminance to reduce the power consumption due to the luminance compensating function and minimize a damage of an organic light emitting diode due to the increased luminance, thereby lengthening the lifespan of the display device.

The effects according to the present disclosure are not limited to the contents exemplified above, and more various effects are included in the present specification.

BRIEF DESCRIPTION OF THE SEVERAL VIEWS OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
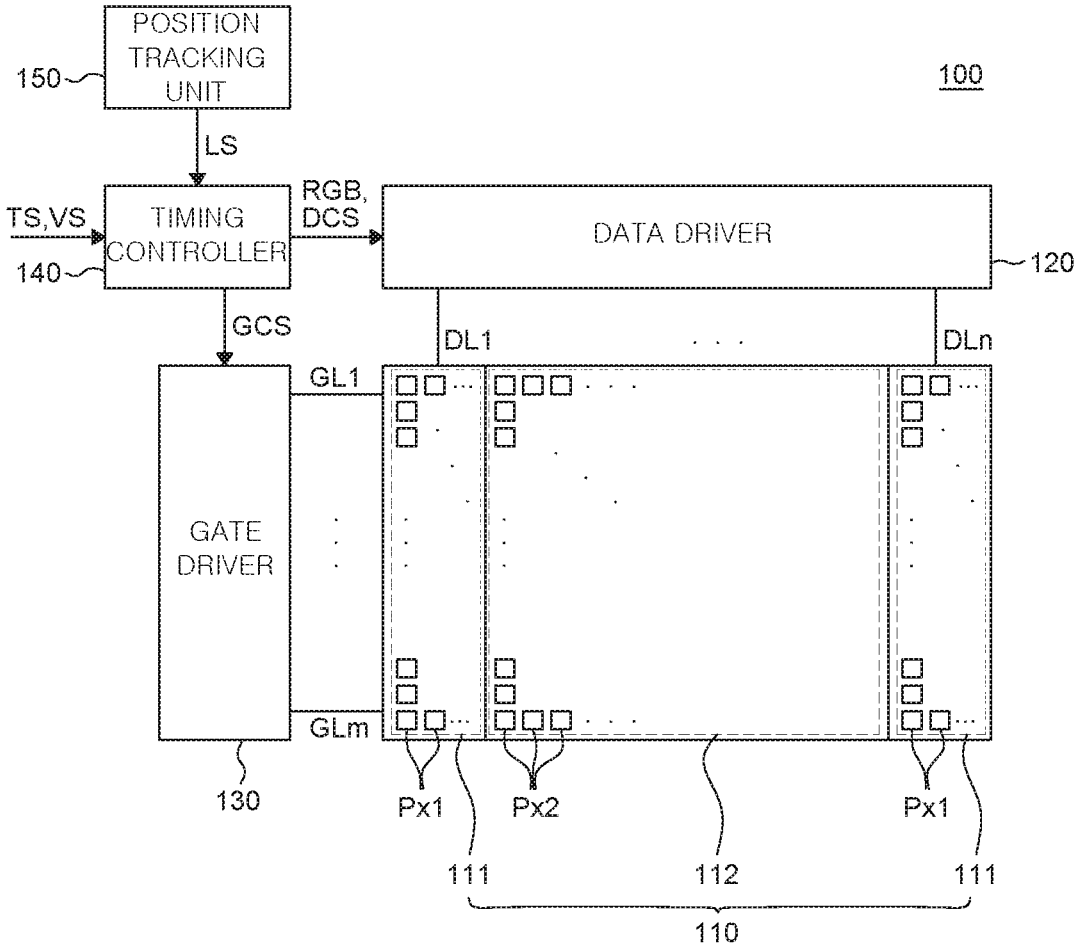
FIG. 1 is a schematic block diagram for explaining a display device according to an exemplary embodiment of the present disclosure.

Advantages and characteristics of the present disclosure and a method of achieving the advantages and characteristics will be clear by referring to exemplary embodiments described below in detail together with the accompanying drawings. However, the present disclosure is not limited to the exemplary embodiment disclosed herein but will be implemented in various forms. The exemplary embodiments are provided by way of example only so that a person of ordinary skill in the art can fully understand the disclosures of the present disclosure and the scope of the present disclosure. Therefore, the present disclosure will be defined only by the scope of the appended claims.

Further, in the following description, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Like reference numerals generally denote like elements throughout the specification.

The features of various embodiments of the present disclosure can be partially or entirely bonded to or combined with each other and can be interlocked and operated in technically various ways understood by those skilled in the art, and the embodiments can be carried out independently of or in association with each other.

Hereinafter, various exemplary embodiments of the present disclosure will be described in detail with reference to accompanying drawings.

FIG. 1 is a schematic block diagram for explaining a display device according to an exemplary embodiment of the present disclosure.

Referring to FIG. 1, a display device 100 includes a display panel 110, a data driver 120, a gate driver 130, a timing controller 140, and a position tracking unit 150.

The display panel 110 is configured such that a plurality of gate lines GL1 to GLm and a plurality of data lines DL1 to DLn intersect each other to be formed in a matrix on a substrate which uses glass or plastic. A plurality of pixels Px1 and Px2 is defined at the intersections of the plurality of gate lines GL1 to GLm and the plurality of data lines DL1 to DLn.

Here, the substrate may be a flexible substrate. That is, a substrate of a display device 100 according to an exemplary embodiment of the present disclosure has a predetermined elasticity to be bent by an external force. To this end, the substrate may be formed of polymer plastic having a bending property such as polyimide (PI).

Each of the pixels Px1 and Px2 of the display panel 110 includes at least one thin film transistor. A gate electrode of the thin film transistor is connected to the gate line GL1 to GLm and a source electrode is connected to the data line DL1 to DLn.

When the display device 100 according to an exemplary embodiment of the present disclosure is a liquid crystal display device, a drain electrode is connected to a pixel electrode facing a common electrode to control a voltage which is applied to liquid crystal. By doing this, movement of the liquid crystal is controlled to implement a gray scale of the liquid crystal display device.

Further, when the display device 100 according to the exemplary embodiment of the present disclosure is an organic light emitting display device, current is applied to an organic light emitting diode (OLED in FIG. 3) equipped in the plurality of pixels Px1 and Px2 and discharged electrons and holes are coupled to generate excitons. The excitons emit light to implement the gray scale of the organic light emitting display device. Details thereof will be described below with reference to FIG. 3.

As described above, the display device 100 according to the exemplary embodiment of the present disclosure is not limited to the liquid crystal display and the organic light emitting display device, but may be various types of display devices.

Figure 2:
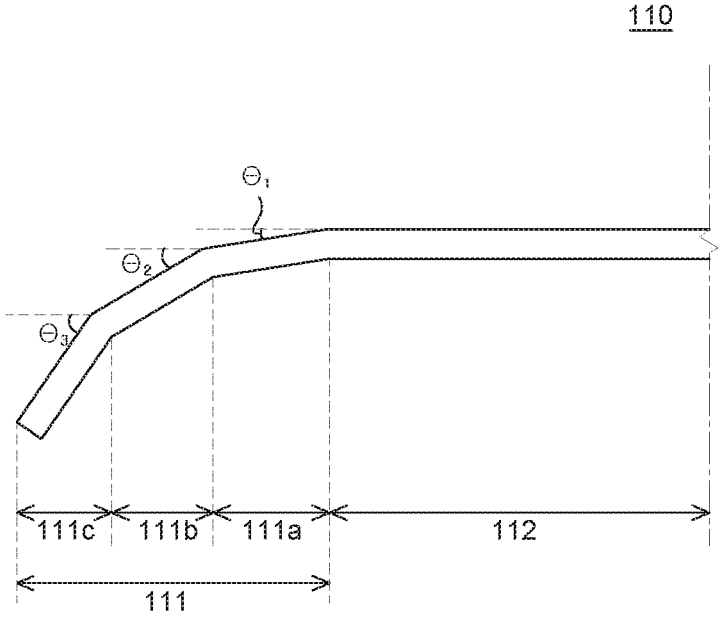
FIG. 2 is a view illustrating a display panel of a display device according to an exemplary embodiment of the present disclosure.

FIG. 2 is a view illustrating a display panel of a display device according to an exemplary embodiment of the present disclosure.

The display panel 110 may include a plane area 112 and a curved area 111. The plane area 112 is disposed at a center portion of the display panel 110 and outputs an image to the front which is a viewing position. The curved area 111 is disposed to be divided into at least one curved area 111 at an outside of the plane area 112. The curved area 111 does not output the image to the front which is a viewing position, but outputs an image while maintaining a predetermined viewing angle with respect to the front. In FIG. 1, the plane area 112 and the curved area 111 are divided to have a predetermined area, but this is merely an example. The plane area 112 and the curved area 111 may vary in accordance with a bending property of the display device 100. For example, the display device 100 may be bent or bendable at a plurality of locations, and the locations of the curved area 111 and the plane area 112 therefore may vary depending on how the display device 100 is bent.

More specifically, referring to FIG. 2, the curved area 111 of the display panel 110 may be divided into a first curved area 111*a*, a second curved area 111*b*, and a third curved area 111*c* having different curvatures. Here, the curvature of the second curved area 111*b* is larger than the curvature of the first curved area 111*a* and the curvature of the third curved area 111*c* is larger than the curvature of the second curved area 111*b*. That is, with respect to the plane area 112, a bending angle $\theta_2$ of the second curved area 111*b* is larger than a bending angle $\theta_1$ of the first curved area 111*a* and a bending angle $\theta_3$ of the third curved area 111*c* is larger than the bending angle $\theta_2$ of the second curved area 111*b*.

Therefore, with respect to the front which is a viewing position, a second viewing angle $\theta_2$ of an image output from the second curved area 111*b* is larger than a first viewing angle $\theta_1$ of an image output from the first curved area 111*a* and a third viewing angle $\theta_3$ of an image output from the third curved area 111*c* is larger than the second viewing angle $\theta_2$ of an image output from the second curved area 111*b*.

Even though in FIG. 2, it is illustrated that the bending angle is increased in the at least one curved area 111 disposed at an outer edge of the display panel 110, it is not limited thereto and the bending angle may vary depending on an external force which is applied to the display panel 110. For example, the curved area 111 may be bent in the opposite direction as shown in FIG. 2, and in some instances, the curved area 111 may include multiple bends in opposite directions.

In the plane area 112 and the curved area 111, a plurality of pixels Px1 and Px2 may be disposed. The plurality of pixels Px2 disposed in the plane area 112 and the plurality of pixels Px1 disposed in the at least one curved area 111 may be distinguishable from one another.

Each of the pixels Px1 and Px2 may include a plurality of sub pixels and each sub pixel may implement light of a specific color. For example, the plurality of sub pixels may be configured by a red sub pixel which implements red, a green sub pixel which implements green, and a blue sub pixel which implements blue, but is not limited thereto.

Figure 3:
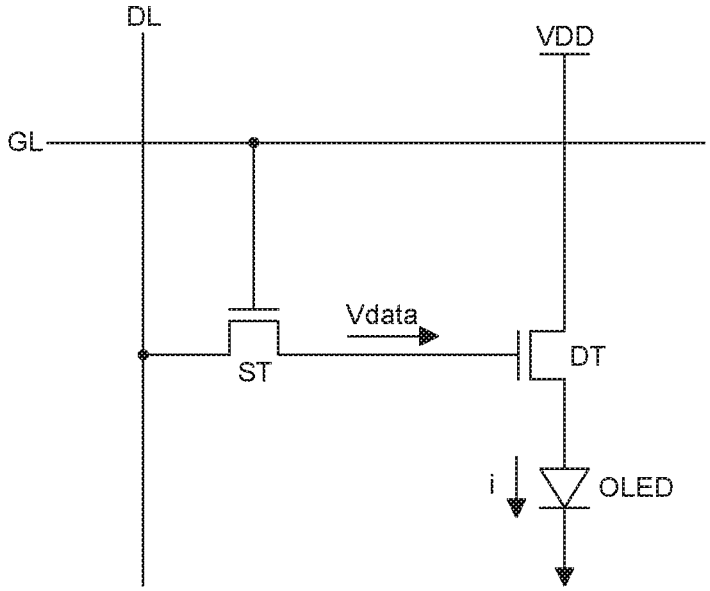
FIG. 3 is a circuit diagram illustrating a pixel disposed on a display panel of a display device according to an exemplary embodiment of the present disclosure.

FIG. 3 is a circuit diagram illustrating a pixel disposed on a display panel of a display device according to an exemplary embodiment of the present disclosure.

The driving of each of the pixels Px1 and Px2 will be described with reference to FIG. 3 as follows. First, a switching transistor ST is turned on by a gate voltage which is supplied to the gate lines GL1 to GLm of each of the pixels Px1 and Px2. Further, a data voltage Vdata is supplied from the data lines DL1 to DLn by the turned-on switching transistor ST and a driving current i is controlled by a driving transistor DT which is applied with the data voltage. Finally, the organic light emitting diode OLED emits light corresponding to the controlled driving current i to display images.

Figure 4A:
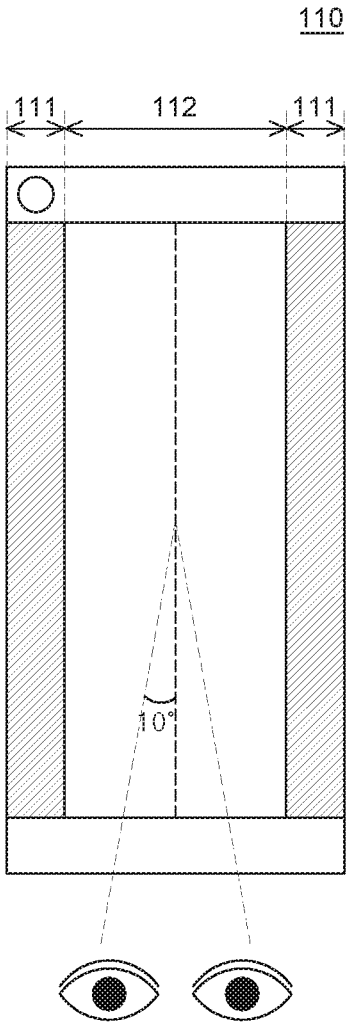
FIGS. 4A and 4B are schematic views for explaining a display panel of a display device according to an exemplary embodiment of the present disclosure and a viewing position.
Figure 4B:
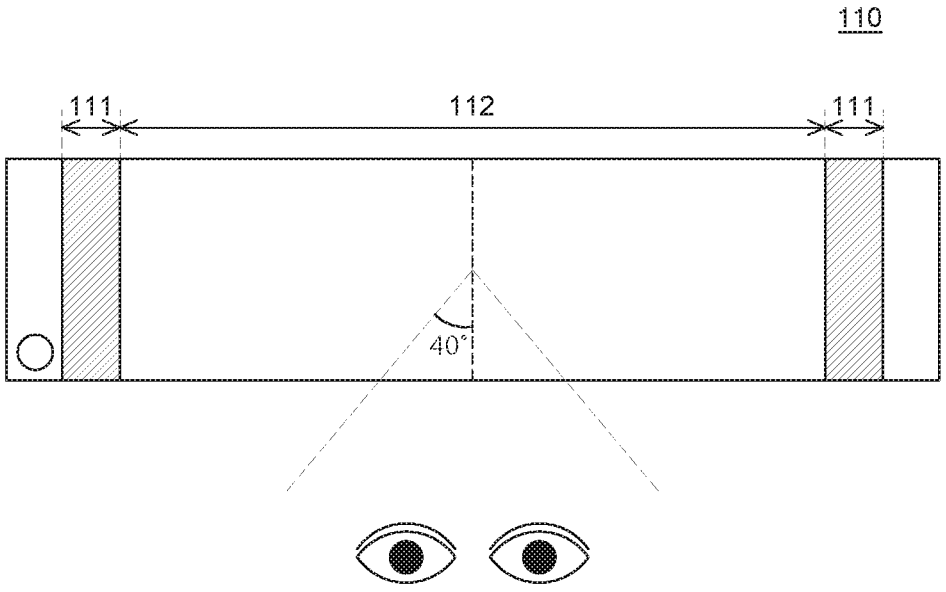

FIGS. 4A and 4B are schematic views for explaining a display panel of a display device according to an exemplary embodiment of the present disclosure and a viewing position.

The position tracker 150, which may be referred to herein as a position tracking unit 150, tracks a position of a viewer to generate a location signal LS.

That is, the position tracking unit 150 generates a location signal LS including location information indicating a location of the viewer with respect to the center of the display panel 110. Here, the location information indicates that the viewer is located within a predetermined angle with respect to the center of the display panel 110.

The position tracking unit 150 may be configured by a camera which may recognize the position of the viewer, but is not limited thereto and all devices which are capable of sensing and/or determining the location of the viewer may correspond to the position tracking unit 150. The position tracking unit 150 may therefore include a sensor, imaging device or the like, such as a camera, to sense or detect a position of the viewer, and further may include or otherwise be communicatively coupled to position determining circuitry, such as a microprocessor, microcontroller or the like, which operably determines the position of the viewer with respect to the center of the display panel 110 based on an output of the camera.

In one or more embodiments, referring to FIG. 4A, when an angle at which the viewer is located is equal to or less than a first threshold angle with respect to a long axis of the display panel 110, the position tracking unit 150 determines that the viewer is watching the display device 100. In some embodiments, the first threshold angle may be 10°, in which case, the position tracking unit 150 determines that the viewer is watching the display device 100 if the angle at which the viewer is located is 10° or less with respect to the long axis.

Further, in one or more embodiments, referring to FIG. 4B, when an angle at which the viewer is located is equal to or less than a second threshold angle with respect to a short axis of the display panel 110, the position tracking unit 150 determines that the viewer is watching the display device 100. In some embodiments, the second threshold angle may be 40°, in which case, the position tracking unit 150 determines that the viewer is watching the display device 100 if the angle at which the viewer is located is 40° or less with respect to the short axis.

In one or more embodiments, the position tracking unit 150 generates the location signal LS based on the position of the viewer with respect to both the long axis and the short axis of the display panel 110. For example, only when the angle at which the viewer is located is 10° or less with respect to the long axis of the display panel 110 and the angle at which the viewer is located is 40° or less with respect to the short axis of the display panel 110, the position tracking unit 150 outputs an on-level location signal LS to activate a luminance compensating function of the display device 100 according to an exemplary embodiment of the present disclosure.

As described above, there is an advantage in that only when it is determined that the viewer watches the display device 100, the luminance compensating function is activated to reduce the power consumption while the viewer does not watch the display panel 110.

The timing controller 140 supplies various control signals DCS and GCS and image data RGB to the data driver 120 and the gate driver 130 to control the data driver 120 and the gate driver 130.

The timing controller 140 starts scanning in accordance with a timing implemented by each frame, based on the timing signal TS received from an external host system. The timing controller 140 converts an image signal VS received from the external host system in accordance with an image data RGB format which is processible in the data driver 120. Further, the timing controller 140 adjusts the luminance of the at least one curved area 111 by analyzing a portion of the image signal $VS_{curved}$ corresponding to the at least one curved area 111 to make the luminance in the front of the display panel 110 uniform. Details thereof will be described below with reference to FIG. 5.

More specifically, the timing controller 140 receives various timing signals TS including a vertical synchronization signal Vsync, a horizontal synchronization signal Hsync, a data enable signal DE, and a data clock signal DCLK together with an image signal VS from the external host system.

In order to control the data driver 120 and the gate driver 130, the timing controller 140 receives the timing signal TS such as the vertical synchronization signal Vsync, the horizontal synchronization signal Hsync, the data enable signal DE, and the data clock signal DCLK and generates various control signals DCS and GCS. The timing controller 140 outputs the various control signals DCS and GCS to the data driver 120 and the gate driver 130.

For example, in order to control the gate driver 130, the timing controller 140 outputs various gate control signals GCS including a gate start pulse GSP, a gate shift clock GSC, and a gate output enable signal GOE.

Here, the gate start pulse controls an operation start timing of one or more gate circuits which configure the gate driver 130. The gate shift clock is a clock signal which is commonly input to one or more gate circuits and controls a shift timing of the scan signal (gate pulse). The gate output enable signal designates timing information of one or more gate circuits.

Further, in order to control the data driver 120, the timing controller 140 outputs various data control signals DCS including a source start pulse SSP, a source sampling clock SSC, and a source output enable signal SOE.

Here, the source start pulse controls a data sampling start timing of one or more data circuits which configure the data driver 120. The source sampling clock is a clock signal which controls a sampling timing of data in each data circuit. The source output enable signal controls an output timing of the data driver 120.

The timing controller 140 may be disposed on a control printed circuit board which is connected to a source printed circuit board to which the data driver 120 is bonded through a connecting medium such as a flexible flat cable (FFC) or a flexible printed circuit (FPC).

In the control printed circuit board, a power controller which supplies various voltages or currents to the display panel 110, the data driver 120, and the gate driver 130 or controls various voltages or currents to be supplied may be further disposed. The power controller may also be referred to as a power management integrated circuit (PMIC).

The source printed circuit board and the control printed circuit board described above may be configured by one printed circuit board.

The gate driver 130 sequentially supplies a gate voltage which is an on-voltage or an off-voltage to the gate lines GL1 to GLm in accordance with the control of the timing controller 140.

According to a driving method, the gate driver 130 may be located only at one side of the display panel 110 or located at both sides if desired.

The gate driver 130 may be connected to a bonding pad of the display panel 110 by means of a tape automated bonding (TAB) method or a chip on glass (COG) method. The gate driver 130 may be implemented to be a gate in panel (GIP) type to be directly disposed in the display panel 110 or may be integrated to be disposed in the display panel 110, if necessary.

The gate driver 130 may include a shift register or a level shifter.

The data driver 120 converts image data RGB received from the timing controller 140 into an analog data voltage Vdata to output the analog data voltage to the data lines DL1 to DLn.

The data driver 120 is connected to the bonding pad of the display panel 110 by a tape automated bonding method or a chip on glass method or may be directly disposed on the display panel 110. If desired, the data driver 120 may be integrated to be disposed in the display panel 110.

Further, the data driver 120 may be implemented by a chip on film (COF) method. In this case, one end of the data driver 120 may be bonded to at least one source printed circuit board and the other end may be bonded to the display panel 110.

The data driver 120 may include a logic unit including various circuits such as a level shifter or a latch unit, a digital analog converter DAC, and an output buffer.

Figure 5:
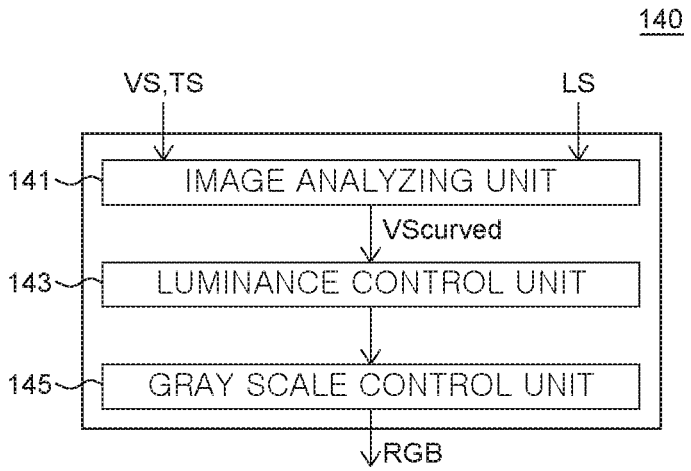
FIG. 5 is a schematic block diagram for explaining a timing controller of a display device according to an exemplary embodiment of the present disclosure.

FIG. 5 is a schematic block diagram for explaining a timing controller of a display device according to an exemplary embodiment of the present disclosure.

Referring to FIG. 5, the timing controller 140 according to the exemplary embodiment of the present disclosure includes an image analyzer 141 (which may be referred to herein as image analyzing unit 141), a luminance controller 143 (which may be referred to herein as luminance control unit 143), and a gray scale controller 145 (which may be referred to herein as gray scale control unit 145).

Figure 6:
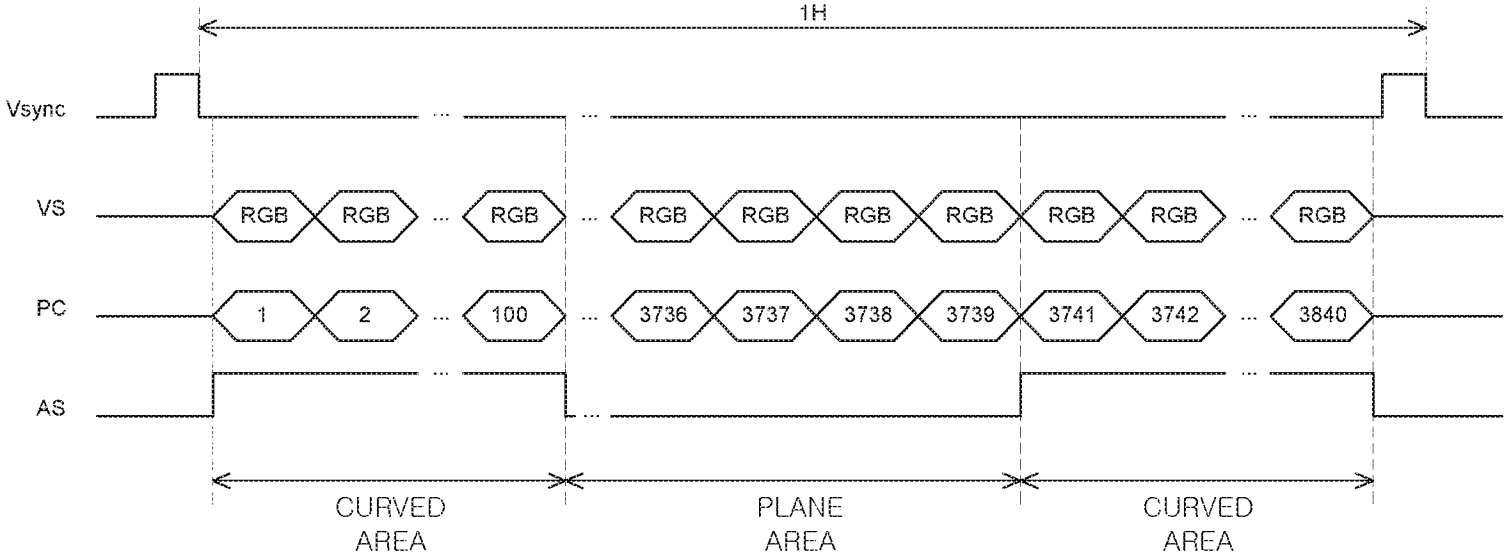
FIG. 6 is a timing chart for explaining an internal signal of a timing controller of a display device according to an exemplary embodiment of the present disclosure.

FIG. 6 is a timing chart for explaining an internal signal of a timing controller of a display device according to an exemplary embodiment of the present disclosure.

The image analyzing unit 141 determines whether the luminance of the at least one curved area 111 is increased, and increases the luminance of the at least one curved area 111, based on the location signal LS.

That is, when the on-level location signal LS is applied, the image analyzing unit 141 increases the luminance of the at least one curved area 111. In contrast, when the off-level location signal LS is applied, the image analyzing unit 141 does not increase the luminance of the at least one curved area 111.

As described above, there is an advantage in that only when it is determined that the viewer watches the display device 100, the luminance compensating function is activated to reduce the power consumption while the viewer does not watch the display panel 110.

The image analyzing unit 141 analyzes the portion of the image signal $VS_{curved}$ corresponding to the at least one curved area 111 to determine whether the luminance of the at least one curved area 111 is increased.

In other words, the image analyzing unit 141 separates, extracts, and analyzes the portion of the image signal $VS_{curved}$ corresponding to the at least one curved area 111 to calculate a predicted luminance $CL_{curved}$ of the curved area 111. Further, the image analyzing unit 141 determines whether the luminance of the at least one curved area 111 is increased, based on the predicted luminance $CL_{curved}$ of the curved area 111.

Specifically, an operation of the image analyzing unit 141 will be described with reference to FIG. 6 as follows. For the convenience of description, it is assumed that the image signal VS including 3840 image data RGB is applied during one horizontal period 1H defined by a vertical synchronization signal Vsync.

The image analyzing unit 141 generates a count signal (pixel count: PC) indicating an order of image data RGB included in the image signal VS during one horizontal period 1H. As illustrated in FIG. 6, the image signal VS includes 3840 image data RGB, so that the count signal PC periodically repeats values of 1 to 3840.

The image analyzing unit 141 separates and extracts a portion of the image signal $VS_{curved}$ corresponding to the at least one curved area 111, in accordance with a predetermined area signal AS.

Here, the area signal AS is in an on-level during a section when the portion of the image signal $VS_{curved}$ corresponding to the at least one curved area 111 is output and is in an off-level during a section when a portion of the image signal VS corresponding to the plane area 112 is output.

Specifically, the area signal AS is in an on-level during sections corresponding to first image data to 100-th image data and sections corresponding to 3741-st image data to 3840-th image data and is in an off-level during remaining sections corresponding to 101-st image data to 3740-th image data.

By doing this, the image analyzing unit 141 separates and extracts the portion of the image signal $VS_{curved}$ of a section when the area signal AS is in an on-level. That is, the image analyzing unit 141 separates and extracts image signals $VS_{curved}$ including first to 100-th image data and 3741-st image data to 3840-th image data.

Next, the image analyzing unit 141 analyzes the image data RGB of the image signal $VS_{curved}$ corresponding to the at least one curved area 111 to predict a luminance $CL_{curved}$ of an image to be output to the curved area 111 and determine whether the luminance of the at least one curved area 111 is increased by calculating a mean square thereof.

Specifically, the image analyzing unit 141 calculates a predicted luminance in the at least one curved area 111 by means of Equation 1.

$$CL_{curved} = \left(\frac{RGB_{curved}}{2^{bits} - 1}\right)^{\gamma}, \quad \text{[Equation 1]}$$

Here, $CL_{curved}$ means a predicted luminance in the at least one curved area 111, $RGB_{curved}$ means image data of the image signal VS corresponding to the at least one curved area 111, bits means a bit number of image data of the image signal VS, and $\gamma$ means a gamma constant of the display device 100.

The image analyzing unit 141 calculates a mean square of the predicted luminance $CL_{curved}$ in the at least one curved area 111 by means of Equation 2 to determine whether to compensate the luminance of the at least one curved area 111.

$$WF_{curved} = \frac{\sum CL_{curved}^2}{\sum CL_{curved}}, \quad \text{[Equation 2]}$$

Here, $WF_{curved}$ means a mean square value of the predicted luminance $CL_{curved}$ and may have a value between 0 to 1. This becomes an index for determining whether the luminance of the at least one curved area 111 of the display device 100 according to the exemplary embodiment of the present disclosure is increased.

With regard to this, the viewer may not recognize luminance deterioration by the curved area 111 at the low luminance but may apparently recognize the luminance deterioration by the curved area 111 at a relatively high luminance. Therefore, there is a necessity to compensate the luminance of the at least one curved area 111 only at a relatively high luminance.

Therefore, only when a mean square value $WF_{curved}$ of the predicted luminance which means a relative intensity of the luminance is equal to or higher than a predetermined value, the luminance of the at least one curved area 111 is increased.

For example, only when a mean square value $WF_{curved}$ of the predicted luminance is equal to or higher than 0.9, the luminance of the at least one curved area 111 is increased and when the mean square value is equal to or lower than 0.9, the luminance of the at least one curved area 111 may not be increased.

Alternatively, as the mean square value $WF_{curved}$ of the predicted luminance is increased, the luminance of the at least one curved area 111 may be gradually increased. For example, when the mean square value $WF_{curved}$ of the predicted luminance is equal to or higher than 0.75 and equal to or lower than 1, a luminance boost ratio of the curved area 111 may be set to be proportional to the mean square value $WF_{curved}$ of the predicted luminance.

As described above, the luminance compensating function of the display device 100 according to the exemplary embodiment of the present disclosure is activated based on the mean value $WF_{curved}$ of the square of the predicted luminance to reduce the power consumption due to the luminance compensating function. Further, the damage of the organic light emitting diode OLED due to the increased luminance is minimized, thereby lengthening the lifespan of the display device 100.

Figure 7A:
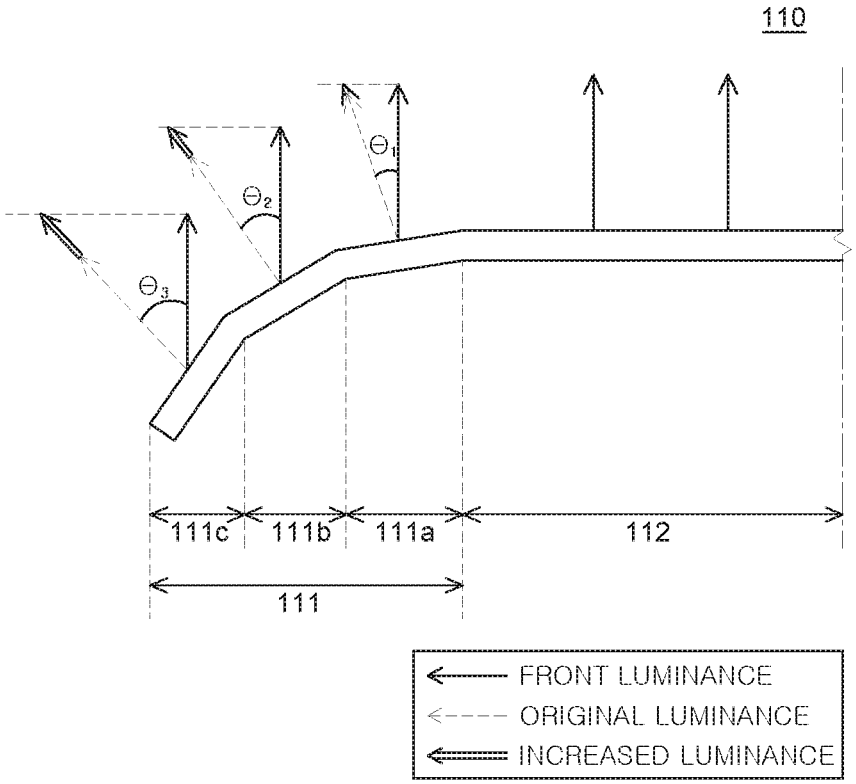
FIGS. 7A and 7B are views for explaining luminance control of a display panel of a display device according to an exemplary embodiment of the present disclosure.
Figure 7B:
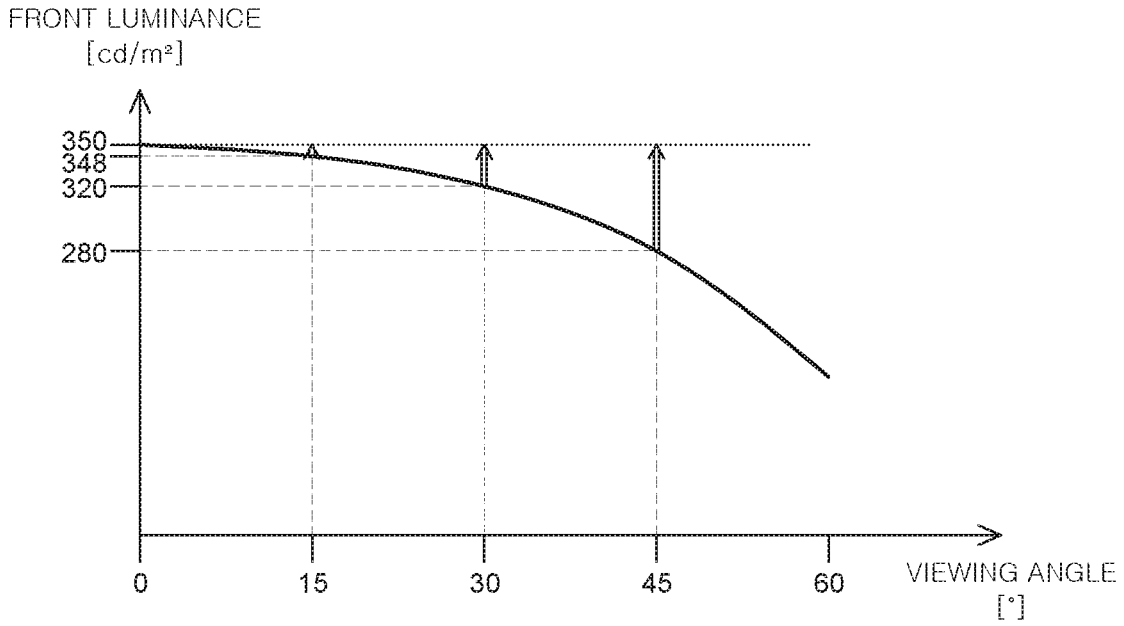

FIGS. 7A and 7B are views for explaining luminance control of a display panel of a display device according to an exemplary embodiment of the present disclosure.

The luminance control unit 143 controls an image signal $VS_{curved}$ corresponding to the at least one curved area 111 to increase the luminance of the at least one curved area 111.

That is, the luminance control unit 143 increases the luminance of the at least one curved area 111 such that a front luminance in a front direction among components of the luminance of the at least one curved area 111 is equal to the luminance of the plane area 112.

Referring to FIG. 7A, the first curved area 111*a* outputs an image while maintaining the first viewing angle $\theta_1$ with respect to the front, the second curved area 111*b* outputs an image while maintaining the second viewing angle $\theta_2$ with respect to the front, and the third curved area 111*c* outputs an image while maintaining the third viewing angle $\theta_3$ with respect to the front. As shown in FIG. 7A, the first, second, and third viewing angles $\theta_1$, $\theta_2$, and $\theta_3$ are measured with respect to a vertical axis (e.g., an axis that is orthogonal to the surface of the plane area 112), while the first, second, and third viewing angles $\theta_1$, $\theta_2$, and $\theta_3$ are measured with respect to a horizontal axis (e.g., an axis parallel to the surface of the plane area 112) in FIG. 2. However, the first, second, and third viewing angles $\theta_1$, $\theta_2$, and $\theta_3$ shown in FIG. 7 may have the same values as the first, second, and third viewing angles $\theta_1$, $\theta_2$, and $\theta_3$ shown in FIG. 2, since they are measured with respect to orthogonal axes. When it is assumed that the entire areas of the display panel 110 have the same luminance, the front luminance (i.e., the portion of the luminance in the vertical direction) is gradually lowered in the order of the first curved area 111*a*, the second curved area 111*b*, and the third curved area 111*c* with respect to the front.

In order to reduce or eliminate the luminance nonuniformity, the luminance of the at least one curved area 111 is increased such that the front luminance is equal to the luminance of the plane area 112. Since the second viewing angle $\theta_2$ of the second curved area 111*b* is larger than the first viewing angle $\theta_1$ of the first curved area 111*a*, the increased luminance of the second curved area 111*b* is higher than the increased luminance of the first curved area 111*a*. Further, since the third viewing angle $\theta_3$ of the third curved area 111*c* is larger than the second viewing angle $\theta_2$ of the second curved area 111*b*, the increased luminance of the third curved area 111*c* is higher than the increased luminance of the second curved area 111*b*. By increasing the luminance of each of the first, second, and third curved areas 111*a*, 111*b*, 111*c*, the components of the luminance from each of these areas that are directed in the front direction are increased, and may be increased so that the front-directed components of luminance from each of the first, second, and third curved areas 111*a*, 111*b*, 111*c* is equal to that of the plane area 112.

Specifically, an operation of the luminance control unit 143 will be described with reference to FIG. 7B as follows. For the convenience of description, it is assumed that the first viewing angle $\theta_1$ of the first curved area 111*a* is 15°, the second viewing angle $\theta_2$ of the second curved area 111*b* is 30°, and the third viewing angle $\theta_3$ of the third curved area 111*c* is 45°.

A front luminance, a luminance boost ratio of the curved area 111, and a data voltage Vdata therefor in accordance with the viewing angles of the curved area 111 are represented in Table 1.

TABLE 1

| Viewing angle [°] | 0 | 15 | 30 | 45 |
|---|---|---|---|---|
| Front luminance [cd/m$^2$] | 350 | 348 | 320 | 280 |
| Boost Ratio | 1 | 1.01 | 1.1 | 1.25 |
| Vdata [v] | 3.2 | 3.2 | 3.5 | 3.9 |

Referring to FIG. 7B and Table 1, a front luminance of the first curved area 111*a* is 348 cd/m$^2$. Therefore, in order to set the front luminance of the first curved area 111*a* to be 350 cd/m$^2$ which is the luminance of the plane area 112, the luminance of the first curved area 111*a* needs to be increased by 1.01 times. To this end, the data voltage Vdata applied to the driving transistor DT illustrated in FIG. 3 needs to be increased.

Next, a front luminance of the second curved area 111*b* is 320 cd/m$^2$. Therefore, in order to set the front luminance of the second curved area 111*b* to be 350 cd/m$^2$ which is the luminance of the plane area 112, the luminance of the second curved area 111*b* needs to be increased by 1.1 times. To this end, the data voltage Vdata applied to the driving transistor DT illustrated in FIG. 3 needs to be increased to 3.5 V.

Next, a front luminance of the third curved area 111*c* is 280 cd/m$^2$. Therefore, in order to set the front luminance of the third curved area 111*c* to be 350 cd/m$^2$ which is the luminance of the plane area 112, the luminance of the third curved area 111*c* needs to be increased by 1.25 times. To this end, the data voltage Vdata applied to the driving transistor DT illustrated in FIG. 3 needs to be increased to 3.9V.

The driving current i of the organic light emitting diode OLED connected to the driving transistor DT is increased due to the increased data voltage Vdata. Therefore, as light emitted from the organic light emitting diode OLED is increased, the luminance of the at least one curved area 111 is increased.

As described above, the luminance of the at least one curved area 111 is increased based on the viewing angle so that a constant luminance may be recognized from the front. By doing this, the luminance uniformity of the display panel 110 is increased so that the deterioration of the image quality due to the curved area 111 may be minimized.

Figure 8:
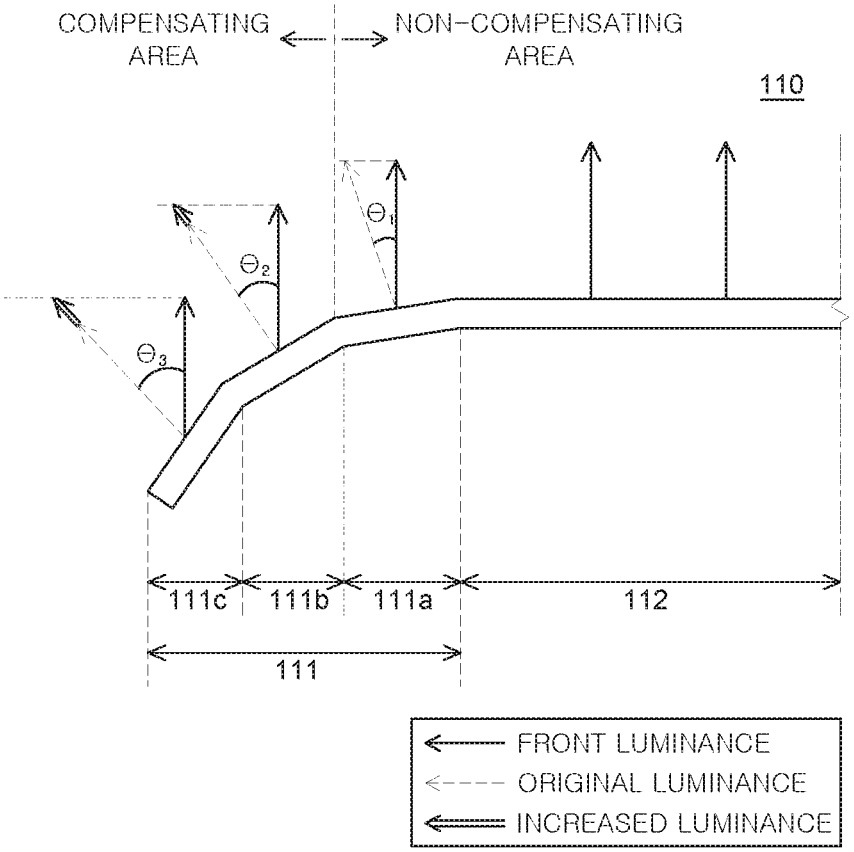
FIG. 8 is a view for explaining a compensating area and a non-compensating area of a display panel of a display device according to an exemplary embodiment of the present disclosure.

FIG. 8 is a view for explaining a compensating area and a non-compensating area of a display panel of a display device according to an exemplary embodiment of the present disclosure.

Separately from this, the luminance control unit 143 may increase the luminance of the at least one curved area 111 such that among the luminance of the at least one curved area 111, the front luminance is higher than a difference between the luminance of the plane area 112 and a threshold luminance (which may be referred to herein as an "identification luminance") and is lower than the luminance of the plane area 112.

That is, the luminance control unit 143 may increase the luminance of the at least one curved area 111 so as to establish the relationship of "luminance of plane area 112>front luminance among luminance of curved area 111>luminance of plane area 112−identification luminance".

Here, the threshold luminance or identification luminance refers to a luminance difference which may be visually perceptible, e.g., which may be visually distinguished from a reference luminance by a viewer. The identification luminance tends to gradually increase as the reference luminance is increased. For example, the luminance is not visually distinguished up to 347.7 cd/m$^2$ with respect to 350 cd/m$^2$ so that the identification luminance is 2.3 cd/m$^2$. Further, the luminance is not visually distinguished up to 994 cd/m$^2$ with respect to 1000 cd/m$^2$ so that the identification luminance is 6 cd/m$^2$.

Therefore, since the front luminance of the first curved area 111*a* is 348 c/m$^2$, a difference between the luminance of the plane area 112 and the front luminance of the first curved area 111 is within the identification luminance. Therefore, even though the luminance of the first curved area 111*a* is not increased, the viewer does not recognize the nonuniformity of the luminance.

Further, even though the front luminances of the second curved area 111*b* and the third curved area 111*c* are increased to be higher than the difference between the luminance of the plane area 112 and the identification luminance and lower than the luminance of the plane area 112, the viewer does not recognize the nonuniformity of the luminance. That is, even though the luminances of the second curved area 111*b* and the third curved area 111*c* are increased not to 350 cd/m2, but to 347.7 cd/m$^2$ to 350 cd/m$^2$, the viewer does not recognize the nonuniformity of the luminance.

That is, as illustrated in FIG. 8, the first curved area 111*a* and the plane area 112 are non-compensating areas in which compensation of the luminance is not necessary and the second curved area 111*b* and the third curved area 111*c* correspond to the compensating areas.

As described above, an increased amount of the front luminance of the at least one curved area 111 is set in consideration of the identification luminance so that the increased amount of the luminance of each curved area 111 may be reduced. By doing this, the power consumption due to the luminance compensating function may be reduced and the damage of the organic light emitting diode OLED due to the increased luminance may be minimized, thereby lengthening the lifespan of the display device 100.

Next, the gray scale control unit 145 controls gray scales of each of the pixels Px1 and Px2 so as to allow the display panel 110 to implement images.

First, the gray scale control unit 145 sets a data voltage Vdata for expressing the gray scales of the pixels Px1 and Px2 after determining a data voltage Vdata for compensating the luminance of the at least one curved area 111. Specifically, the gray scale control unit 145 divides a data voltage Vdata for compensating the luminance of the at least one curved area 111 to set a data voltage Vdata for expressing the gray scales of the pixels Px1 and Px2.

For example, in order to express 255 gray scales which are full gray scales, when the pixels Px1 disposed in the third curved area 111*c* needs 3.9 V of data voltage Vdata, 3.9 V of data voltage Vdata is divided through a resistor string R-string to determine the data voltage Vdata for expressing individual gray scales.

A difference of data voltages Vdata for expressing differences in individual gray scales may be constant, but may be gradually increased in consideration of visual property of the people.

The gray scale control unit 145 outputs the image data RGB to the data driver 120 so as to reflect the data voltage Vdata determined as described above so that the image is implemented on the display panel 110.

As described above, in the display device according to the exemplary embodiment of the present disclosure, the luminance of the at least one curved area 111 is increased based on the viewing angle so that a constant luminance may be recognized from the front. By doing this, the luminance uniformity of the display panel 110 is increased so that the deterioration of the image quality due to the curved area 111 may be minimized.

Figure 9A:
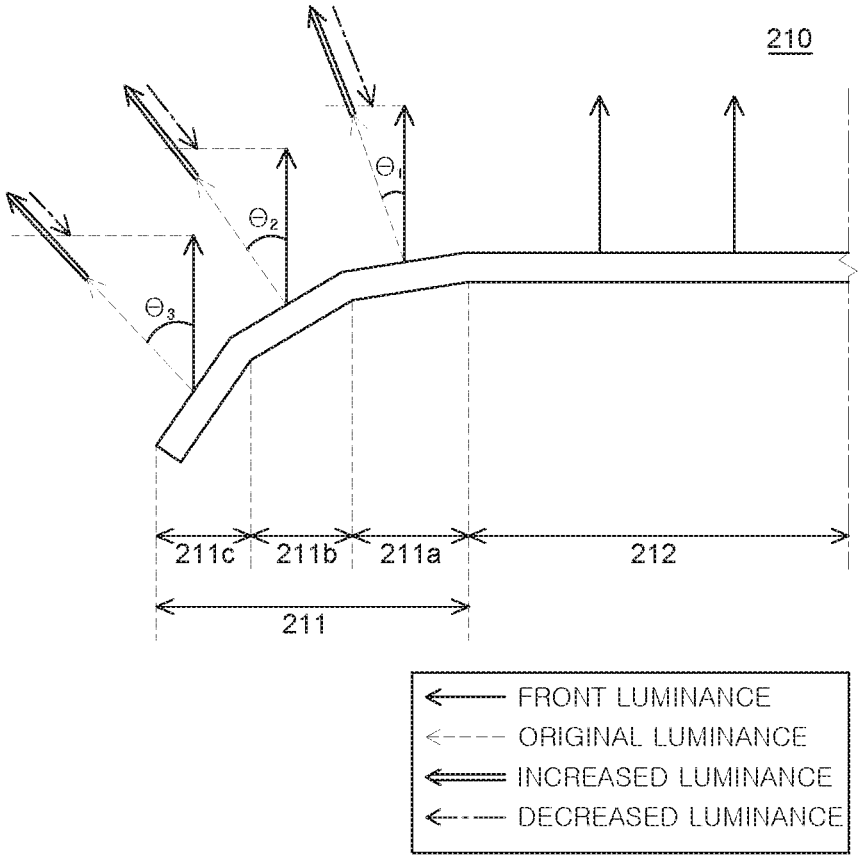
FIGS. 9A and 9B are views for explaining luminance control and gray scale control of a display panel of a display device according to another exemplary embodiment of the present disclosure.
Figure 9B:
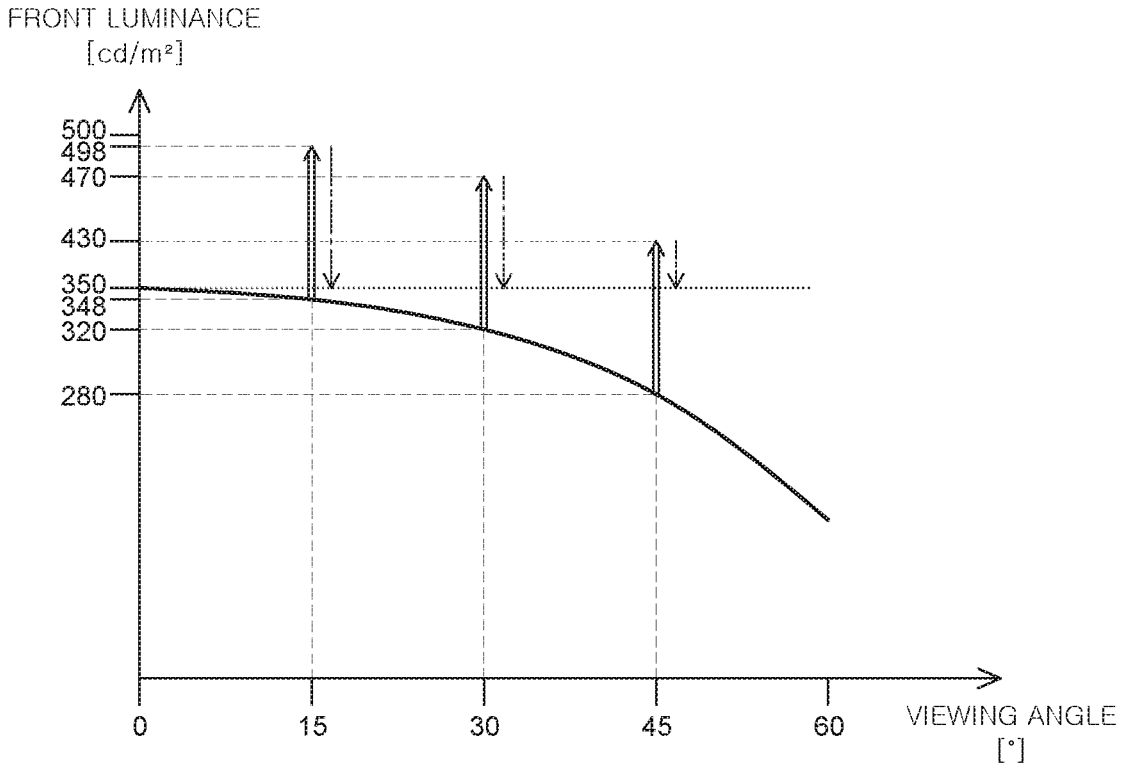

FIGS. 9A and 9B are views for explaining luminance control and gray scale control of a display panel of a display device according to another exemplary embodiment of the present disclosure.

Hereinafter, a display device according to another exemplary embodiment of the present disclosure will be described with reference to FIGS. 9A and 9B. A repeated description with the exemplary embodiment of the present disclosure will be omitted.

During a luminance control step, an image signal $VS_{curved}$ corresponding to the at least one curved area 211 is controlled to increase the luminance of the at least one curved area 211.

That is, during the luminance control step, the luminance of a curved area 211 is increased such that a front luminance in a front direction among components of the luminance of a curved area 211 is equal to or higher than the luminance of the plane area 212.

Specifically, referring to FIG. 9A, a first curved area 211*a* outputs an image while maintaining the first viewing angle $\theta_1$ with respect to the front, a second curved area 211*b* outputs an image while maintaining the second viewing angle $\theta_2$ with respect to the front, and a third curved area 211*c* outputs an image while maintaining the third viewing angle $\theta_3$ with respect to the front. Therefore, when it is assumed that the entire areas of the display panel 210 have the same luminance, the front luminance is gradually lowered in the order of the first curved area 211*a*, the second curved area 211*b*, and the third curved area 211*c* with respect to the front.

Here, in the at least one curved area 211, the luminance of the third curved area 211*c* is increased such that the front luminance of the third curved area 211*c* which has the lowest front luminance is equal to or higher than the luminance of the plane area 212. Further, similarly, the luminances of the first curved area 2111*a* and the second curved area 211*b* are increased by an increased amount of the luminance of the third curved area 211*c*.

As described above, the luminance of the at least one curved area 211 is increased by the increased amount of the luminance of the third curved area 211*c* so that the front luminance of the at least one curved area 211 is equal to or higher than the luminance of the plane area 212.

Therefore, since the second viewing angle $\theta_2$ of the second curved area 211*b* is larger than the first viewing angle $\theta_1$ of the first curved area 211*a*, the front luminance of the second curved area 211*b* is lower than the front luminance of the first curved area 211*a*. Further, since a third viewing angle $\theta_3$ of the third curved area 211*c* is larger than the second viewing angle $\theta_2$ of the second curved area 211*b*, the front luminance of the third curved area 211*c* is lower than the front luminance of the second curved area 211*b*.

Next, the gray scale control unit 245 controls the gray scale of the at least one curved area 211 such that a front luminance in a front direction among components of the luminance of the at least one curved area 211 is equal to the luminance of the plane area 212.

That is, the gray scale control unit 245 decreases the front luminance by differently adjusting the gray scales of the first curved area 211*a*, the second curved area 211*b*, and the third curved area 211*c* so that the front luminance of the at least one curved area 211 becomes uniform.

Referring to FIG. 9A, since the front luminance of the first curved area 211*a* is higher than the front luminance of the second curved area 211*b*, a decreased amount of luminance by the gray scale adjustment of the first curved area 211*a* is larger than a decreased amount of luminance by the gray scale adjustment of the second curved area 211*b*. Further, since the front luminance of the second curved area 211*b* is higher than the front luminance of the third curved area 211*c*, a decreased amount of luminance by the gray scale adjustment of the second curved area 211*b* is larger than a decreased amount of luminance by the gray scale adjustment of the third curved area 211*c*.

Specifically, operations of the luminance control unit 243 and the gray scale control unit 245 will be described with reference to FIG. 9B as follows. For the convenience of description, it is assumed that the first viewing angle $\theta_1$ of the first curved area 211*a* is 15°, the second viewing angle $\theta_2$ of the second curved area 211*b* is 30°, and the third viewing angle $\theta_3$ of the third curved area 211*c* is 45°.

Here, the increased amount of luminance of the at least one curved area 211 may be set such that the front luminance of the at least one curved area 211 is equal to or higher than the luminance of the plane area 212. However, in the following description, the increased amount of luminance of the at least one curved area 211 is set such that the front luminance of the at least one curved area 211 is higher than the luminance of the plane area 212, for example.

In the case of the third curved area 211*c*, when the front luminance of is 280 cd/m$^2$ and the increased amount of luminance of the at least one curved area 211 is 150 cd/m$^2$, the entire front luminance is 430 cd/m$^2$. Therefore, in order to set the front luminance of the third curved area 211*c* to be 350 cd/m$^2$ which is the luminance of the plane area 212, the gray scale of the third curved area 211*c* is decreased such that the front luminance of the third curved area 211*c* is decreased by 80 cd/m$^2$.

Next, in the case of the second curved area 211*b*, when the front luminance is 320 cd/m$^2$ and the amount of increased luminance of the at least one curved area 211 is 150 cd/m$^2$, the entire front luminance is 470 cd/m$^2$. Therefore, in order to set the front luminance of the second curved area 211*b* to be 350 cd/m$^2$ which is the luminance of the plane area 212, the gray scale of the second curved area 211*b* is decreased so that the front luminance of the second curved area 211*b* is decreased by 120 cd/m$^2$.

Next, in the case of the first curved area 211*a*, when the front luminance is 348 cd/m$^2$ and the amount of increased luminance of the at least one curved area 211 is 150 cd/m$^2$, the entire front luminance is 498 cd/m$^2$. Therefore, in order to set the front luminance of the first curved area 211*a* to be 350 cd/m$^2$ which is the luminance of the plane area 212, the gray scale of the first curved area 211*a* is decreased so that the front luminance of the first curved area 211*a* is decreased by 148 cd/m$^2$.

As described above, similarly, the luminance of the at least one curved area 211 is increased and the gray scale is decreased based on the viewing angle so that a constant luminance may be recognized from the front. By doing this, the luminance uniformity of the display panel 210 is increased so that the deterioration of the image quality due to the curved area 211 may be minimized.

Differently from this, the gray scale control unit 245 may decrease the gray scale of the at least one curved area 211 such that among the luminance of the at least one curved area 212, the front luminance is higher than a difference between the luminance of the plane area 212 and an identified luminance and is lower than the luminance of the plane area 212.

That is, the gray scale control unit 245 may decrease the gray scale of the at least one curved area 211 so as to establish the relationship of "luminance of plane area 212>front luminance among luminance of curved area 211>luminance of plane area 212–identification luminance".

Therefore, even though the front luminance of the at least one curved area 211 is increased to be higher than a difference between the luminance of the plane area 212 and the identification luminance and to be lower than the luminance of the plane area 212, the viewer may not recognize the nonuniformity of the luminance. That is, even though the front luminance of the at least one curved area 211 is increased not to 350 cd/m$^2$, but to 347.7 cd/m$^2$ to 350 cd/m$^2$, the viewer does not recognize the nonuniformity of the luminance.

As described above, a decreased amount of the gray scale of the at least one curved area 211 is set in consideration of the identification luminance so that the increased amount of the luminance of each curved area 211 may be reduced. By doing this, the power consumption due to the luminance compensating function may be reduced and the damage of the organic light emitting diode OLED due to the increased luminance may be minimized, thereby lengthening the lifespan of the display device 100.

Hereinafter, a driving method of a display device according to an exemplary embodiment of the present disclosure will be described with reference to FIG. 10.

Figure 10:
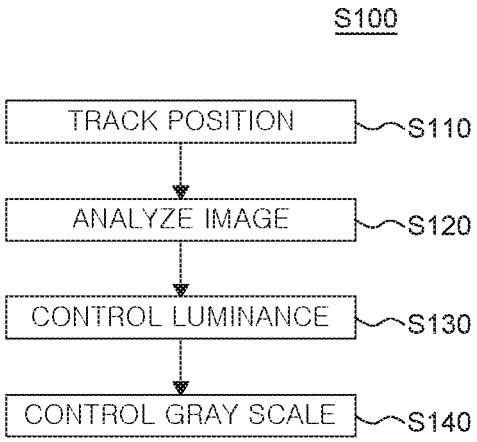
FIG. 10 is a flowchart for explaining a driving method of a display device according to one exemplary embodiment of the present disclosure.

FIG. 10 is a flowchart for explaining a driving method of a display device according to one exemplary embodiment of the present disclosure.

The driving method S100 of the display device according to the exemplary embodiment of the present disclosure includes a position tracking step S110, an image analyzing step S120, a luminance control step S130, and a gray scale control step S140.

During the position tracking step S110, a position of the viewer is determined with respect to the center of the display panel 110. That is, during the position tracking step S110, it is identified whether the viewer is located within a predetermined angle with respect to the center of the display panel 110.

Specifically, referring to FIG. 4A, during the position tracking step S110, when an angle at which the viewer is located is equal to or less than a first threshold angle (e.g., 10° or less) with respect to a long axis of the display panel 110, it is determined that the viewer is watching the display device 100.

Further, referring to FIG. 4B, during the position tracking step S110, when an angle at which the viewer is located is equal to or less than a second threshold angle (e.g., 40° or less) with respect to a short axis of the display panel 110, it is determined that the viewer is watching the display device 100. In some embodiments, the position tracking unit 150 may determine that the viewer is watching the display device in response to both conditions being met, i.e., that the viewer is located at an angle equal to or less than the first threshold angle with respect to the long axis and at an angle equal to or less than the second threshold angle with respect to the short axis.

Therefore, during the position tracking step S110, only when the angle at which the viewer is located is 10° or less with respect to a long axis of the display panel 110 and when the angle at which the viewer is located is 40° or less with respect to a short axis of the display panel 110, a luminance compensating function by the driving method S100 of the display device according to an exemplary embodiment of the present disclosure is activated.

As described above, there is an advantage in that only when it is determined that the viewer watches the display device 100, the luminance compensating function is activated to reduce the power consumption while the viewer does not watch the display panel 110.

During the image analyzing step S120, the image signal $VS_{curved}$ corresponding to the at least one curved area 111 is analyzed to determine whether the luminance of the at least one curved area 111 is increased.

In other words, during the image analyzing step S120, the image signal $VS_{curved}$ corresponding to the at least one curved area 111 is separated, extracted, and analyzed to calculate a predicted luminance $CL_{curved}$ of the curved area 111. Further, during the image analyzing step, it is determined whether the luminance of the at least one curved area 111 is increased, based on the predicted luminance $CL_{curved}$ of the curved area 111.

For the convenience of description, it is assumed that the image signal VS including 3840 image data RGB is applied during one horizontal period 1H defined by a vertical synchronization signal Vsync. Specifically, during the image analyzing step S120, image signals $VS_{curved}$ including first image data to 100-th image data and 3741-st image data to 3840-th image data which are image signals $VS_{curved}$ corresponding to the at least one curved area 111 are separated and extracted.

Next, during the image analyzing step S120, the image data RGB of the image signal $VS_{curved}$ corresponding to the at least one curved area 111 is analyzed to predict a luminance $CL_{curved}$ of an image to be output to the curved area 111 and determine whether the luminance of the at least one curved area 111 is increased by calculating a mean square thereof.

Specifically, during the image analyzing step S120, a predicted luminance in the at least one curved area 111 is calculated by means of Equation 1.

$$CL_{curved} = \left(\frac{RGB_{curved}}{2^{bits} - 1}\right)^{\gamma} \quad \text{[Equation 1]}$$

Here, $CL_{curved}$ means a predicted luminance in the at least one curved area 111, $RGB_{curved}$ means image data of the image signal VS corresponding to the at least one curved area 111, bits means a bit number of image data of the image signal VS, and γ means a gamma constant of the display device 100.

During the image analyzing step S120, a mean square of the predicted luminance $CL_{curved}$ in the at least one curved area 111 is calculated by means of Equation 2 to determine whether to compensate the luminance of the at least one curved area 111.

$$WF_{curved} = \frac{\sum CL_{curved}^2}{\sum CL_{curved}} \quad \text{[Equation 2]}$$

Here, $WF_{curved}$ means a mean square value of the predicted luminance $CL_{curved}$ and may have a value between 0 to 1. This becomes an index for determining whether the luminance of the at least one curved area 111 of the display device 100 according to the exemplary embodiment of the present disclosure is increased.

With regard to this, the viewer may not recognize the luminance deterioration by the curved area 111 at the low luminance but may apparently recognize the luminance deterioration by the curved area 111 at a relatively high luminance. Therefore, the luminance of the at least one curved area 111 needs to be compensated only at a relatively high luminance.

Therefore, only when a mean square value $WF_{curved}$ of the predicted luminance which means a relative intensity of the luminance is equal to or higher than a predetermined value, the luminance of the at least one curved area 111 is increased.

For example, only when a mean square value $WF_{curved}$ of the predicted luminance is equal to or higher than 0.9, the luminance of the at least one curved area 111 is increased and when the mean square value is equal to or lower than 0.9, the luminance of the at least one curved area 111 may not be increased.

Alternatively, as the mean square value $WF_{curved}$ of the predicted luminance is increased, the luminance of the at least one curved area 111 may be gradually increased. For example, when the mean square value $WF_{curved}$ of the predicted luminance is equal to or higher than 0.75 and equal to or lower than 1, a luminance boost ratio of the curved area 111 may be set to be proportional to the mean square value $WF_{curved}$ of the predicted luminance.

As described above, the luminance compensating function of the display device 100 according to the exemplary embodiment of the present disclosure is activated based on the mean value $WF_{curved}$ of the square of the predicted luminance to reduce the power consumption by the luminance compensating function. Further, the damage of the organic light emitting diode OLED due to the increased luminance is minimized, thereby lengthening the lifespan of the display device 100.

Next, during the luminance control step S130, an image signal $VS_{curved}$ corresponding to the at least one curved area 111 is controlled to increase the luminance of the at least one curved area 111.

That is, during the luminance control step S130, the luminance of the at least one curved area 111 is increased such that a front luminance in a front direction among components of the luminance of the at least one curved area 111 is equal to the luminance of the plane area 112.

Referring to FIG. 7A, the first curved area 111*a* outputs an image while maintaining the first viewing angle $\theta_1$ with respect to the front, the second curved area 111*b* outputs an image while maintaining the second viewing angle $\theta_2$ with respect to the front, and the third curved area 111*c* outputs an image while maintaining the third viewing angle $\theta_3$ with respect to the front. Therefore, when it is assumed that the entire areas of the display panel 110 have the same luminance, the front luminance is gradually lowered in the order of the first curved area 111*a*, the second curved area 111*b*, and the third curved area 111*c* with respect to the front.

In order to reduce or eliminate the luminance nonuniformity, the luminance of the at least one curved area 111 is increased such that the front luminance is equal to the luminance of the plane area 112. Since the second viewing angle $\theta_2$ of the second curved area 111*b* is larger than the first viewing angle $\theta_1$ of the first curved area 111*a*, the increased luminance of the second curved area 111*b* is higher than the increased luminance of the first curved area 111*a*. Further, since the third viewing angle $\theta_3$ of the third curved area 111*c* is larger than the second viewing angle $\theta_2$ of the second curved area 111*b*, the increased luminance of the third curved area 111*c* is higher than the increased luminance of the second curved area 111*b*.

Specifically, the luminance control step S130 will be described with reference to FIG. 7B as follows. For the convenience of description, it is assumed that the first viewing angle $\theta_1$ of the first curved area 111*a* is 15°, the second viewing angle $\theta_2$ of the second curved area 111*b* is 30°, and the third viewing angle $\theta_3$ of the third curved area 111*c* is 45°.

The front luminance and the luminance boost ratio of the curved area 111 in accordance with the viewing angle of the curved area 111 are represented in Table 1.

TABLE 1

| Viewing angle [°] | 0 | 15 | 30 | 45 |
|---|---|---|---|---|
| Front luminance [cd/m²] | 350 | 348 | 320 | 280 |
| Boost Ratio | 1 | 1.01 | 1.1 | 1.25 |
| Vdata [v] | 3.2 | 3.2 | 3.5 | 3.9 |

Referring to FIG. 7B and Table 1, a front luminance of the first curved area 111*a* is 348 cd/m². Therefore, in order to set the front luminance of the first curved area 111*a* to be 350 cd/m² which is the luminance of the plane area 112, the luminance of the first curved area 111*a* needs to be increased by 1.01 times.

Next, a front luminance of the second curved area 111*b* is 320 cd/m². Therefore, in order to set the front luminance of the second curved area 111*b* to be 350 cd/m² which is the luminance of the plane area 112, the luminance of the second curved area 111*b* needs to be increased by 1.1 times. Next, a front luminance of the third curved area 111*c* is 280 cd/m². Therefore, in order to set the front luminance of the third curved area 111*c* to be 350 cd/m² which is the luminance of the plane area 112, the luminance of the third curved area 111*c* needs to be increased by 1.25 times.

As described above, during the luminance control step S130, the luminance of the at least one curved area 111 is increased based on the viewing angle so that a constant luminance may be recognized from the front. By doing this, the luminance uniformity of the display panel 110 is increased so that the deterioration of the image quality due to the curved area 111 may be minimized.

Differently from this, during the luminance control step S130, the luminance of the at least one curved area 111 may be increased such that among the luminance of the at least one curved area 111, the front luminance is higher than a difference between the luminance of the plane area 112 and an identified luminance and is lower than the luminance of the plane area 112.

That is, during the luminance control step S130, the luminance of the at least one curved area 111 may be increased so as to establish the relationship of "luminance of plane area 112>front luminance among luminance of curved area 111>luminance of plane area 112−identification luminance".

Here, the identification luminance means a luminance difference which may be visibly distinguished from a reference luminance by a viewer. The identification luminance tends to gradually increase as the reference luminance is increased. For example, the luminance is not visually distinguished up to 347.7 cd/m$^2$ with respect to 350 cd/m$^2$ so that the identification luminance is 2.3 cd/m$^2$. Further, the luminance is not visually distinguished up to 994 cd/m$^2$ with respect to 1000 cd/m$^2$ so that the identification luminance is 6 cd/m$^2$.

Therefore, since the front luminance of the first curved area 111*a* is 348 c/m$^2$, a difference between the luminance of the plane area 112 and the front luminance of the first curved area 111 is within the identification luminance. Therefore, even though the luminance of the first curved area 111*a* is not increased, the viewer does not recognize the ununiformity of the luminance.

Further, the front luminances of the second curved area 111*b* and the third curved area 111*c* are increased to be higher than a difference between the luminance of the plane area 112 and the identification luminance and lower than the luminance of the plane area 112, the viewer does not recognize the nonuniformity of the luminance. That is, even though the luminances of the second curved area 111*b* and the third curved area 111*c* are increased not to 350 cd/m2, but to 347.7 cd/m$^2$ to 350 cd/m$^2$, the viewer does not recognize the nonuniformity of the luminance.

That is, as illustrated in FIG. 8, the first curved area 111*a* and the plane area 112 are non-compensating areas in which compensation of the luminance is not necessary and the second curved area 111*b* and the third curved area 111*c* correspond to the compensating areas.

As described above, during the luminance control step S130, an increased amount of the front luminance of the at least one curved area 111 is set in consideration of the identification luminance so that the increased amount of the luminance of each curved area 111 may be reduced. By doing this, the power consumption due to the luminance compensating function may be reduced and the damage of the organic light emitting diode OLED due to the increased luminance may be minimized, thereby lengthening the lifespan of the display device 100.

Next, during the gray scale control step S140, gray scales of each of the pixels Px1 and Px2 are controlled so as to allow the display panel 110 to implement images.

First, during the gray scale control step S140, a data voltage Vdata for expressing the gray scales of the pixels Px1 and Px2 is set after determining a data voltage Vdata for compensating the luminance of the at least one curved area 111. First, during the gray scale control step S140, a data voltage Vdata for expressing the gray scales of the pixels Px1 and Px2 is set by dividing a data voltage Vdata for compensating the luminance of the at least one curved area 111.

As described above, according to the display device according to the exemplary embodiment of the present disclosure, the luminance of the at least one curved area 111 is increased based on the viewing angle so that a constant luminance may be recognized from the front. By doing this, the luminance uniformity of the display panel 110 is increased so that the deterioration of the image quality due to the curved area 111 may be minimized.

Hereinafter, a driving method of a display device according to another exemplary embodiment of the present disclosure will be described. A repeated description with the exemplary embodiment of the present disclosure will be omitted. The driving method S200 may be substantially the same as the driving method S100 shown in FIG. 10, except that the driving method S200 includes a luminance control step S230 which is different from the luminance control step S130 of FIG. 10, and includes a gray scale control step S240 which is different from the gray scale control step S140 of FIG. 10, as will be described in further detail below.

During a luminance control step S230 of a driving method S200 of a display device according to another exemplary embodiment of the present disclosure, an image signal $VS_{curved}$ corresponding to a curved area 211 is controlled to increase the luminance of the at least one curved area 211.

That is, during the luminance control step S230, the luminance of the at least one curved area 211 is increased such that a front luminance in a front direction among components of the luminance of the at least one curved area 211 is equal to or higher than the luminance of the plane area 212.

Specifically, referring to FIG. 9A, a first curved area 211*a* outputs an image while maintaining the first viewing angle $\theta_1$ with respect to the front, a second curved area 211*b* outputs an image while maintaining the second viewing angle $\theta_2$ with respect to the front, and a third curved area 211*c* outputs an image while maintaining the third viewing angle $\theta_3$ with respect to the front. Therefore, when it is assumed that the entire areas of the display panel 210 have the same luminance, the front luminance is gradually lowered in the order of the first curved area 211*a*, the second curved area 211*b*, and the third curved area 211*c* with respect to the front.

Here, in the at least one curved area 211, the luminance of the third curved area 211*c* is increased such that the front luminance of the third curved area 211*c* which has the lowest front luminance is equal to or higher than the luminance of the plane area 212. Further, the luminances of the first curved area 211*a* and the second curved area 211*b* are increased by an increased amount of the luminance of the third curved area 211*c*.

As described above, the luminance of the at least one curved area 211 is increased by the increased amount of the luminance of the third curved area 211*c* so that the front luminance of the at least one curved area 211 is equal to or higher than the luminance of the plane area 212.

Therefore, since a second viewing angle $\theta_2$ of the second curved area 211*b* is larger than a first viewing angle $\theta_1$ of the first curved area 211*a*, the front luminance of the second curved area 211*b* is lower than the front luminance of the first curved area 211*a*. Further, since a third viewing angle $\theta_3$ of the third curved area 211*c* is larger than the second viewing angle $\theta_2$ of the second curved area 211*b*, the front luminance of the third curved area 211*c* is lower than the front luminance of the second curved area 211*b*.

Next, during the gray scale control step S240, the gray scale of the at least one curved area 211 is controlled such that a front luminance in a front direction among components of the luminance of the at least one curved area 211 is equal to the luminance of the plane area 212.

That is, during the gray scale control step S240, the front luminance is decreased by differently adjusting the gray scales of the first curved area 211*a*, the second curved area 211*b*, and the third curved area 211*c* so that the front luminance of the at least one curved area 211 becomes uniform.

Referring to FIG. 9A, since the front luminance of the first curved area 211*a* is higher than the front luminance of the second curved area 211*b*, an amount of decreased luminance by the gray scale adjustment of the first curved area 211*a* is larger than an amount of decreased luminance by the gray scale adjustment of the second curved area 211*b*. Further, since the front luminance of the second curved area 211*b* is higher than the front luminance of the third curved area 211*c*, an amount of decreased luminance by the gray scale adjustment of the second curved area 211*b* is larger than an amount of decreased luminance by the gray scale adjustment of the third curved area 211*c*.

Specifically, operations of the luminance control unit 243 and the gray scale control unit 245 will be described with reference to FIG. 9B as follows. For the convenience of description, it is assumed that the first viewing angle $\theta_1$ of the first curved area 211*a* is 15°, the second viewing angle $\theta_2$ of the second curved area 211*b* is 30°, and the third viewing angle $\theta_3$ of the third curved area 211*c* is 45°.

Here, the amount of increased luminance of the at least one curved area 211 may be set such that the front luminance of the at least one curved area 211 is equal to or higher than the luminance of the plane area 212. However, in the following description, the amount of increased luminance of the at least one curved area 211 is set such that the front luminance of the at least one curved area 211 is higher than the luminance of the plane area 212, for example.

In the case of the third curved area 211*c*, when the front luminance is 280 cd/m$^2$ and the amount of increased luminance of the at least one curved area 211 is 150 cd/m$^2$, the entire front luminance is 430 cd/m$^2$. Therefore, in order to set the front luminance of the third curved area 211*c* to be 350 cd/m$^2$ which is the luminance of the plane area 212, the gray scale of the third curved area 211*c* is decreased such that the front luminance is decreased by 80 cd/m$^2$.

Next, in the second curved area 211*b*, when the front luminance is 320 cd/m$^2$ and the amount of increased luminance of the at least one curved area 211 is 150 cd/m$^2$, the entire front luminance is 470 cd/m$^2$. Therefore, in order to set the front luminance of the second curved area 211*b* to be 350 cd/m$^2$ which is the luminance of the plane area 212, the gray scale of the second curved area 211*b* is decreased so that the front luminance is decreased by 120 cd/m$^2$.

Next, in the first curved area 211*a*, when the front luminance is 348 cd/m$^2$ and the amount of increased luminance of the at least one curved area 211 is 150 cd/m$^2$, the entire front luminance is 498 cd/m$^2$. Therefore, in order to set the front luminance of the first curved area 211*a* to be 350 cd/m$^2$ which is the luminance of the plane area 212, the gray scale of the first curved area 211*a* is decreased so that the front luminance is decreased by 148 cd/m$^2$.

As described above, according to the driving method S200 of the display device according to another exemplary embodiment of the present disclosure, the luminance of the at least one curved area 211 is increased and the gray scale is decreased based on the viewing angle so that a constant luminance may be recognized from the front. By doing this, the luminance uniformity of the display panel 210 is increased so that the deterioration of the image quality due to the curved area 211 may be minimized.

Differently from this, during the gray scale control step S240, the gray scale of the at least one curved area 211 is decreased such that among the luminance of the at least one curved area 212, the front luminance is higher than a difference between the luminance of the plane area 212 and an identified luminance and is lower than the luminance of the plane area 212.

That is, the gray scale control unit 245 may decrease the gray scale of the at least one curved area 211 so as to establish the relationship of "luminance of plane area 212>front luminance among luminance of curved area 211>luminance of plane area 212−identification luminance".

Therefore, even though the front luminance of the at least one curved area 211 is increased to be higher than a difference between the luminance of the plane area 212 and the identification luminance and to be lower than the luminance of the plane area 212, the viewer may not recognize the nonuniformity of the luminance. That is, the luminance of the at least one curved area 211 is increased not to 350 cd/m$^2$, but to 347.7 cd/m$^2$ to 350 cd/m$^2$, the viewer does not recognize the nonuniformity of the luminance.

As described above, during the gray scale control step S240, a decreased amount of the gray scale of the at least one curved area 211 is set in consideration of the identification luminance so that the increased amount of the luminance of each curved area 211 may be reduced. By doing this, the power consumption due to the luminance compensating function may be saved and the damage of the organic light emitting diode OLED due to the increased luminance may be minimized, thereby lengthening the lifespan of the display device 100.

The exemplary embodiments of the present disclosure can also be described as follows:

According to an aspect of the present disclosure, a display device includes: a display panel which includes a plane area and at least one curved area disposed at the outside of the plane area; a timing controller which is applied with an image signal to generate image data; and a data driver which is applied with the image data to output a data voltage to a plurality of pixels disposed in the plane area and in the at least one curved area a plurality of pixels disposed in the at least one curved area in which the timing controller includes an image analyzing unit which analyzes the corresponding to the at least one curved area image signal corresponding to the at least one curved area and a luminance control unit which controls the corresponding to the at least one curved area image signal corresponding to the at least one curved area to increase luminance of the at least one curved area a luminance of the at least one curved area.

According to another aspect of the present disclosure, the display device may further include: a position tracking unit which tracks a position of a viewer to generate a location signal including a location information of the viewer and the image analyzing unit may determine whether to increase the luminance of the at least one curved area, based on the location signal.

According to still another aspect of the present disclosure, the image analyzing unit may analyze an corresponding to the at least one curved area image signal corresponding to the at least one curved area to calculate a predicted luminance of the at least one curved area and determine whether to increase the luminance of the at least one curved area, based on the predicted luminance of the at least one curved area.

According to still another aspect of the present disclosure, the data driver may increase a data voltage output to the plurality of pixels disposed in the at least one curved area, based on the image data corresponding to the at least one curved area, and the plurality of pixels disposed in the at least one curved area may include at least one organic light emitting diode, and a driving current of the at least one organic light emitting diode may be increased by the increased data voltage.

According to still another aspect of the present disclosure, the luminance control unit may increase the luminance of the at least one curved area such that a front luminance among the luminance of the at least one curved area is equal to the luminance of the plane area.

According to still another aspect of the present disclosure, the luminance control unit may increase the luminance of the at least one curved area such that a front luminance among the luminance of the at least one curved area is higher than a difference between the luminance of the plane area and an identification luminance and is lower than the luminance of the plane area.

According to another aspect of the present disclosure, the timing controller may further include a gray scale control unit which controls a gray scale of the at least one curved area, the luminance control unit may increases the luminance of the at least one curved area such that a front luminance among the luminance of the at least one curved area is equal to or higher than the luminance of the plane area, and the gray scale control unit may decrease the gray scale of the at least one curved area.

According to another aspect of the present disclosure, the gray scale control unit may decrease the gray scale of the at least one curved area such that a front luminance among the luminance of the at least one curved area is equal to the luminance of the plane area.

According to still another aspect of the present disclosure, the gray scale control unit may decrease a gray scale of the at least one curved area such that a front luminance among the luminance of the at least one curved area is higher than a difference between the luminance of the plane area and an identification luminance and is lower than the luminance of the plane area.

According to another aspect of the present disclosure, a driving method of a display device includes an image analyzing step of analyzing an corresponding to the at least one curved area image signal corresponding to the at least one curved area and a luminance control step of increasing luminance of the at least one curved area a luminance of the at least one curved area.

According to another aspect of the present disclosure, the driving method may further include a gray scale control step of increasing the luminance of the at least one curved area such that a front luminance among the luminance of the at least one curved area is equal to or higher than the luminance of the plane area and decreasing a gray scale of the at least one curved area.

According to still another aspect of the present disclosure, during the gray scale control step, the gray scale of the at least one curved area may be decreased such that a front luminance among the luminance of the at least one curved area is equal to the luminance of the plane area.

According to still another aspect of the present disclosure, during the gray scale control step, a gray scale of the at least one curved area may be decreased such that a front luminance among the luminance of the at least one curved area is higher than a difference between the luminance of the plane area and an identification luminance and is lower than the luminance of the plane area.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical concept of the present disclosure. The scope of the technical concept of the present disclosure is not limited thereto. Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device, comprising:

a display panel having a plane area and at least one curved area disposed outside of the plane area;

a timing controller which is applied with an image signal to generate image data; and a data driver which is applied with the image data to output a data voltage to a plurality of pixels disposed in the plane area and in the at least one curved area, wherein the timing controller includes:

an image analyzer which analyzes a portion of the image signal corresponding to the at least one curved area, wherein the image analyzer calculates a predicted luminance of the at least one curved area based on the portion of the image signal corresponding to the at least one curved area, and determines whether to increase a luminance of the at least one curved area, based on the predicted luminance of the at least one curved area; and a luminance controller which controls the portion of the image signal corresponding to the at least one curved area to increase the luminance of the at least one curved area according to the determination of the image analyzer.

2. The display device according to claim 1, further comprising:

a position tracker which tracks a position of a viewer and generates a location signal including location information indicating a location of the viewer, wherein the image analyzer determines whether to increase the luminance of the at least one curved area, based on the location signal.

3. The display device according to claim 2, wherein the image analyzer:

determines whether a first angle at which the viewer is located with respect to a long axis of the display panel is equal to or less than a first threshold angle;

determines whether a second angle at which the viewer is located with respect to a short axis of the display panel is equal to or less than a second threshold angle; and determines to increase the luminance of the at least one curved area in response to determining that the first angle is equal to or less than the first threshold angle and the second angle is equal to or less than the second threshold angle.

4. The display device according to claim 3, wherein the first threshold angle is 10° and the second threshold angle is 40°.

5. The display device according to claim 3, wherein the image analyzer determines not to increase the luminance of the at least one curved area in response to determining that the first angle is greater than the first threshold angle or the second angle is greater than the second threshold angle.

6. The display device according to claim 1, wherein the data driver increases a data voltage output to the plurality of pixels disposed in the at least one curved area, based on the portion of the image data corresponding to the at least one curved area, and the plurality of pixels disposed in the at least one curved area includes:

at least one organic light emitting diode, and a driving current of the at least one organic light emitting diode is increased by the increased data voltage.

7. The display device according to claim 1, wherein the luminance controller increases a front luminance of the at least one curved area to a level that is equal to a luminance of the plane area, the front luminance being a component of the luminance of the at least one curved area along a direction orthogonal to a surface of the plane area.

8. The display device according to claim 1, wherein the luminance controller increases a front luminance of the at least one curved area to a level that is higher than a difference between a luminance of the plane area and a threshold luminance and is lower than the luminance of the plane area, the front luminance being a component of the luminance of the at least one curved area along a direction orthogonal to a surface of the plane area.

9. The display device according to claim 8 wherein the threshold luminance corresponds to a visually perceptible change in the luminance of the plane area.

10. The display device according to claim 1, wherein the timing controller further includes a gray scale controller which controls a gray scale of the at least one curved area, the luminance controller increases a front luminance of the at least one curved area to a level that is equal to or higher than a luminance of the plane area, the front luminance being a component of the luminance of the at least one curved area along a direction orthogonal to a surface of the plane area, and the gray scale controller decreases the gray scale of the at least one curved area corresponding to the increased amount of the luminance of each curved area based on a viewing angle.

11. The display device according to claim 10, wherein the gray scale controller decreases the gray scale of the at least one curved area such that the front luminance of the at least one curved area is equal to the luminance of the plane area.

12. The display device according to claim 10, wherein the gray scale controller decreases the gray scale of the at least one curved area such that the front luminance of the at least one curved area is higher than a difference between the luminance of the plane area and an identification luminance and is lower than the luminance of the plane area.

13. A driving method of a display device which includes a display panel having a plane area and at least one curved area outside of the plane area, the driving method comprising:

analyzing a portion of an image signal corresponding to the at least one curved area, wherein the analyzing the portion of an image signal includes calculating a predicted luminance of the at least one curved area based on the portion of the image signal corresponding to the at least one curved area, and determining whether to increase a luminance of the at least one curved area, based on the predicted luminance of the at least one curved area; and increasing the luminance of the at least one curved area based on the analyzing the portion of the image signal corresponding to the at least one curved area according to the determination of the image analyzing.

14. The driving method according to claim 13, wherein the increasing the luminance of the at least one curved area includes increasing a front luminance of the at least one curved area to a level that is equal to or higher than a luminance of the plane area, the method further comprising:

decreasing a gray scale of the at least one curved area corresponding to the increased amount of the luminance of each curved area based on a viewing angle.

15. The driving method according to claim 14, wherein decreasing the gray scale includes decreasing the gray scale of the at least one curved area such that the front luminance of the at least one curved area is equal to the luminance of the plane area.

16. The driving method according to claim 14, wherein decreasing the gray scale includes decreasing the gray scale of the at least one curved area such that the front luminance of the at least one curved area is higher than a difference between the luminance of the plane area and an identification luminance and is lower than the luminance of the plane area.

17. The driving method according to claim 13, further comprising:

tracking a position of a viewer; and determining whether the viewer is located within a predetermined angle with respect to a center of the display device, based on the tracked position of the viewer, wherein the increasing the luminance of the at least one curved area is performed in response to determining that the viewer is located within the predetermined angle.

18. The driving method according to claim 17, wherein the determining whether the viewer is located within a predetermined angle with respect to a center of the display device includes:

determining whether a first angle at which the viewer is located with respect to a long axis of the display panel is equal to or less than a first threshold angle; and determining whether a second angle at which the viewer is located with respect to a short axis of the display panel is equal to or less than a second threshold angle.

19. The driving method according to claim 18, wherein the increasing the luminance of the at least one curved area includes:

increasing the luminance of the at least one curved area in response to determining that the first angle is equal to or less than the first threshold angle and the second angle is equal to or less than the second threshold angle.

* * * * *